US007296622B2

(12) United States Patent
Wang

(10) Patent No.: US 7,296,622 B2
(45) Date of Patent: Nov. 20, 2007

(54) LABYRINTH SEAL FOR PUMPING SYSTEM

(75) Inventor: Chengbao Wang, Oklahoma City, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 308 days.

(21) Appl. No.: 11/070,986

(22) Filed: Mar. 3, 2005

(65) Prior Publication Data

US 2006/0196655 A1 Sep. 7, 2006

(51) Int. Cl.
*E21B 43/34* (2006.01)

(52) U.S. Cl. ..... 166/105.4; 166/105.1

(58) Field of Classification Search ..... 166/105–105.5, 166/50, 265; 210/170.01, 520
See application file for complete search history.

(56) References Cited

U.S. PATENT DOCUMENTS 5,588,486 A * 12/1996 Heinrichs ..... 166/105.5

* cited by examiner

*Primary Examiner*—Lanna Mai
*Assistant Examiner*—Matthew J. Smith
(74) *Attorney, Agent, or Firm*—Crowe & Dunlevy, P.C.

(57) ABSTRACT

A seal section for a downhole pumping system includes a fluid exchange pathway and a rotatable gravity separator. The rotatable gravity separator preferably includes a chamber, a backwash inlet connecting the chamber to the fluid exchange pathway and a backwash outlet connecting the chamber to the fluid exchange pathway. The rotatable gravity separator further includes a weight that causes the rotatable gravity separator to remain in a substantially constant orientation with respect to the force of gravity.

19 Claims, 3 Drawing Sheets

LABYRINTH SEAL FOR PUMPING SYSTEM

FIELD OF THE INVENTION

This invention relates generally to the field of downhole pumping systems, and more particularly to seal sections for use in horizontal downhole pumping systems.

BACKGROUND

Submersible pumping systems are often deployed into wells to recover petroleum fluids from subterranean reservoirs. Typically, a submersible pumping system includes a number of components, such as an electric motor coupled to one or more pump assemblies. In many cases, seal sections are placed between pumps and motors. Seal sections are designed to protect intricate internal motor components from harmful wellbore fluids. Seal sections are also used to accommodate the expansion of lubricants from the electric motor and act as a downthrust support during a pumping operation.

Equipment manufacturers have experimented with a number of different types of seal sections. Many seal sections employ an expandable bag or bellows that increases in volume as fluids move through the seal section. Although generally effective, the materials used to manufacture the expandable components are often susceptible to chemical breakdown under the inhospitable downhole environment. Other manufacturers have employed complex labyrinth systems that filter contaminated fluids with gravity-based traps. The labyrinth system often includes a series of ports and chambers that force contaminated fluids to travel upward, thereby allowing gravity to separate heavier contaminated fluids and solids from cleaner, less harmful fluids.

In many installations, modern labyrinth systems effectively filter contaminated fluids moving through the seal section. The success of existing labyrinth systems is, however, dependent on the proper orientation of the seal section with respect to the force of gravity. In non-vertical wells, it is particularly difficult to maintain the proper orientation of labyrinth systems in seal sections. During installation or use, the entire pumping system may rotate, thereby changing the relative positions of the various components within the labyrinth system. If, for example, the labyrinth system becomes inverted or even tipped horizontally, contaminants otherwise trapped by gravity in a proper installation may "fall" into lower portions of the seal section or pumping system. It is to these and other deficiencies in the prior art that the present invention is directed.

SUMMARY OF THE INVENTION

In a preferred embodiment, the present invention provides a seal section for a downhole pumping system that includes a fluid exchange pathway and a rotatable gravity separator. The rotatable gravity separator preferably includes a chamber, a backwash inlet connecting the chamber to the fluid exchange pathway and a backwash outlet connecting the chamber to the fluid exchange pathway. The rotatable gravity separator further includes a weight that causes the rotatable gravity separator to remain in a substantially constant orientation with respect to the force of gravity.

DETAILED DESCRIPTION OF THE PREFERRED EMBODIMENT

Figure 1:
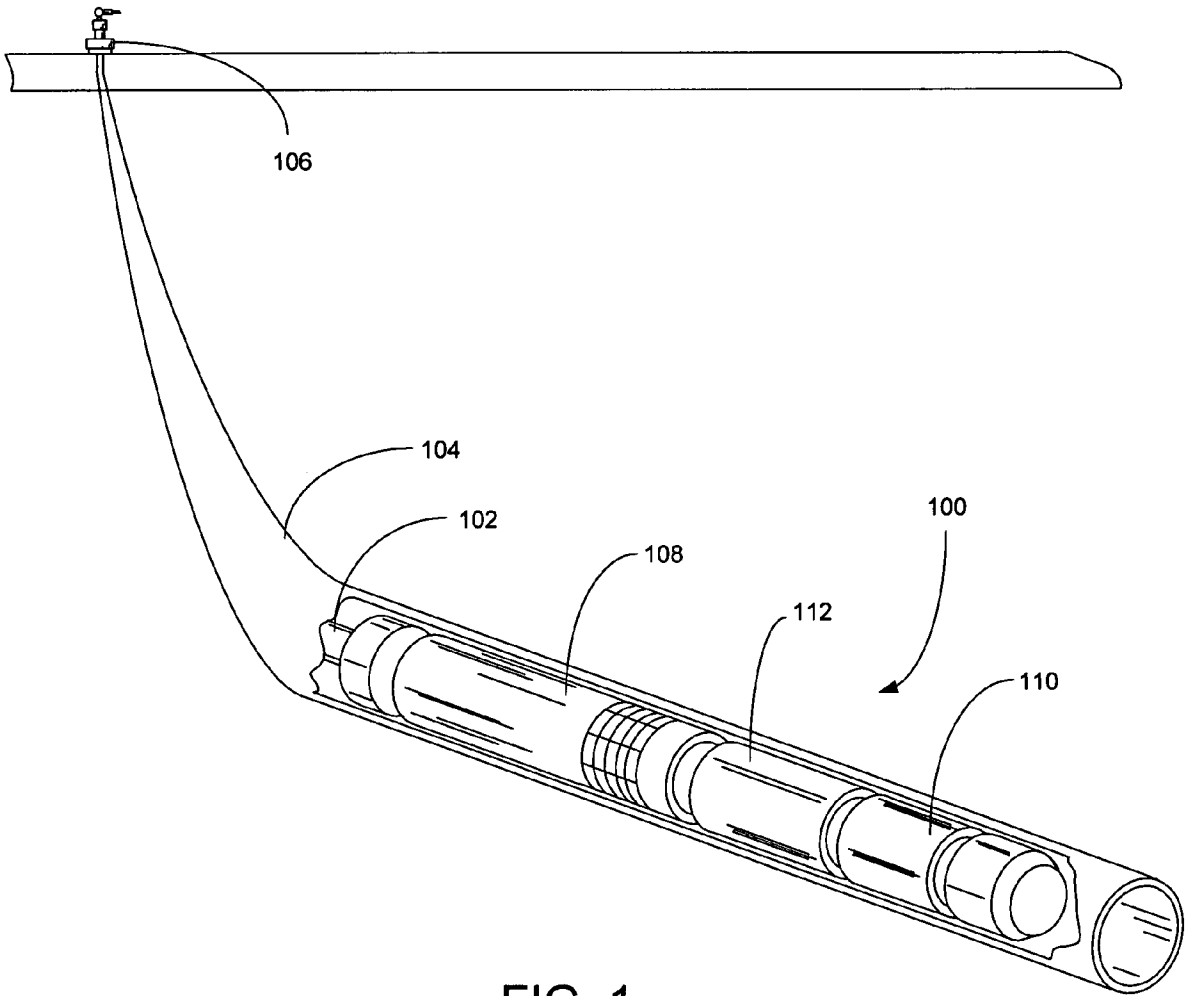
FIG. 1 is a front perspective view of a downhole pumping system in a non-vertical installation.

In accordance with a preferred embodiment of the present invention, FIG. 1 shows a front perspective view of a downhole pumping system 100 attached to production tubing 102. The downhole-pumping system 100 and production tubing 102 are disposed in a wellbore 104, which is drilled for the production of a fluid such as water or petroleum. The downhole pumping system 100 is shown in a non-vertical well. This type of angled well is often referred to as a "horizontal" well.

As used herein, the term "petroleum" refers broadly to all mineral hydrocarbons, such as crude oil, gas and combinations of oil and gas. The production tubing 102 connects the pumping system 100 to a wellhead 106 located on the surface. Although the pumping system 100 is primarily designed to pump petroleum products, it will be understood that the present invention can also be used to move other fluids. It will also be understood that, although each of the components of the pumping system 100 are primarily disclosed in a submersible application, some or all of these components can also be used in surface pumping operations.

The pumping system 100 preferably includes some combination of a pump assembly 108, a motor assembly 110 and a seal section 112. In a preferred embodiment, the motor assembly 110 is an electrical motor that receives its power from a surface-based supply. The motor assembly 110 converts the electrical energy into mechanical energy, which is transmitted to the pump assembly 108 by one or more shafts. The pump assembly 108 then transfers a portion of this mechanical energy to fluids within the wellbore, causing the wellbore fluids to move through the production tubing to the surface. In a particularly preferred embodiment, the pump assembly 108 is a turbomachine that uses one or more impellers and diffusers to convert mechanical energy into pressure head. In an alternative embodiment, the pump assembly 108 is a progressive cavity (PC) pump that moves wellbore fluids with one or more screws or pistons.

The seal section 112 shields the motor assembly 110 from mechanical thrust produced by the pump assembly 108. The seal section 112 is also preferably configured to prevent the introduction of contaminants from the wellbore 104 into the motor assembly 110. Although only one pump assembly 108, seal section 112 and motor assembly 110 are shown, it will be understood that the downhole pumping system 100 could include additional pumps assemblies 108, seals sections 112 or motor assemblies 110.

Figure 2:
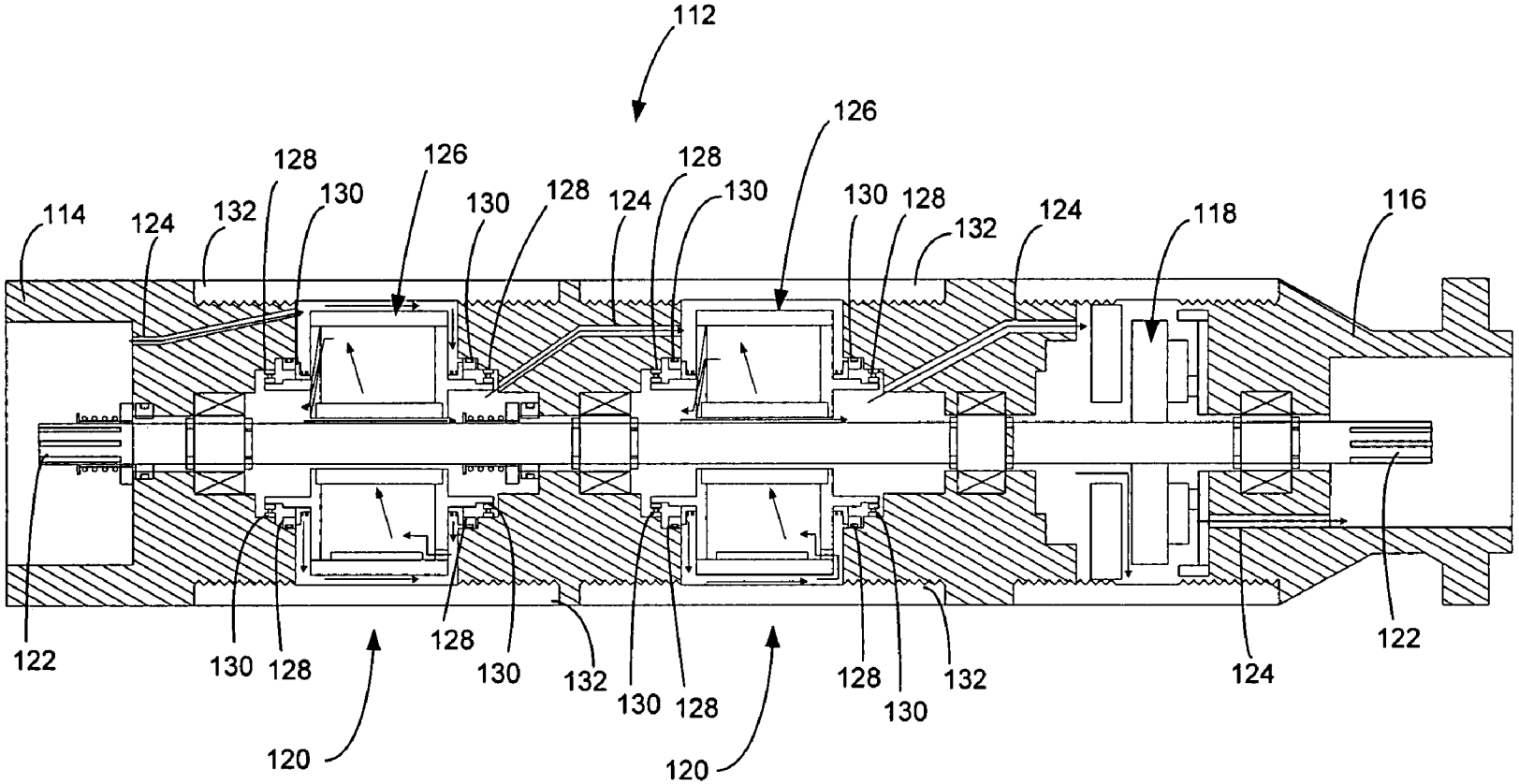
FIG. 2 is a side cross-sectional view of a seal section of the preferred embodiment.

Turning to FIG. 2, shown therein is a side cross-sectional view of the seal section 112. In a presently preferred embodiment, the seal section 112 is assembled from several separate pieces. The seal section preferably includes a head 114, a base 116, a thrust bearing assembly 118 and one or more labyrinth assemblies 120. The head 114 and base 116 are preferably configured for connection to the pump assembly 108 and motor assembly 110, respectively. The seal section 112 also includes a shaft 122 that transfers mechanical energy from the motor assembly 110 to the pump assembly 108. The thrust bearing assembly 118 is preferably configured to limit axial movement of the shaft 122.

The seal section 112 also includes a fluid exchange pathway 124 that includes a series of ports, vents, recesses and channels (not separately designated) that permit the movement of fluid within the seal section 112 and between the motor assembly 110 and the pump assembly 108. In the presently preferred embodiment, the seal section 112 is filled with a suitable lubricant before installation.

During use, lubricants from the motor assembly 110 expand and move into the seal section 112, thereby displacing a portion of the fluid in the seal section 112. The displaced fluids from the seal section 112 are directed into the pump assembly 108, vented to the wellbore 104 or contained within an expandable chamber (not shown). In the presently preferred embodiment, lubricants displaced from the seal section 112 are ported to the pump assembly 108 through the head 114. As the motor assembly 110 cools, lubricants within the seal section 112 recede into the motor assembly 110. Wellbore fluids are then drawn into the seal section 112 through the fluid exchange pathway 124 from the pump assembly 108 and mixed with clean lubricants. For the purposes of this disclosure, the movement of fluids out of the motor assembly 110 is referred to as "effluent." In contrast, movement of fluids through the seal section 112 from the pump assembly 108 is herein referred to as "backwash."

To prevent or mitigate the introduction of contaminants into the motor assembly 110 from backwashed wellbore fluids, the labyrinth assemblies 120 are placed in fluid communication with the fluid exchange pathway 124. The labyrinth assemblies 120 preferably include a rotatable gravity separator 126, one or more bearing assemblies 128, one or more mechanical seals 130 and a housing 132. The bearing assemblies 128 allow the labyrinth assemblies 120 to independently rotate with respect to the other components within the seal section 112. In a particularly preferred embodiment, the bearing assemblies 128 are constructed using ball bearings. In an alternative embodiment, the rotatable gravity separator 126 rotates on hydrodynamic bearings. Although two labyrinth assemblies 120 are shown, it will be understood that fewer or additional labyrinth assemblies 120 could be employed. Furthermore, the labyrinth assemblies 120 could be used in combination with other types of seal devices, such as, for example, expandable bags or bellows (not shown).

Figure 3:
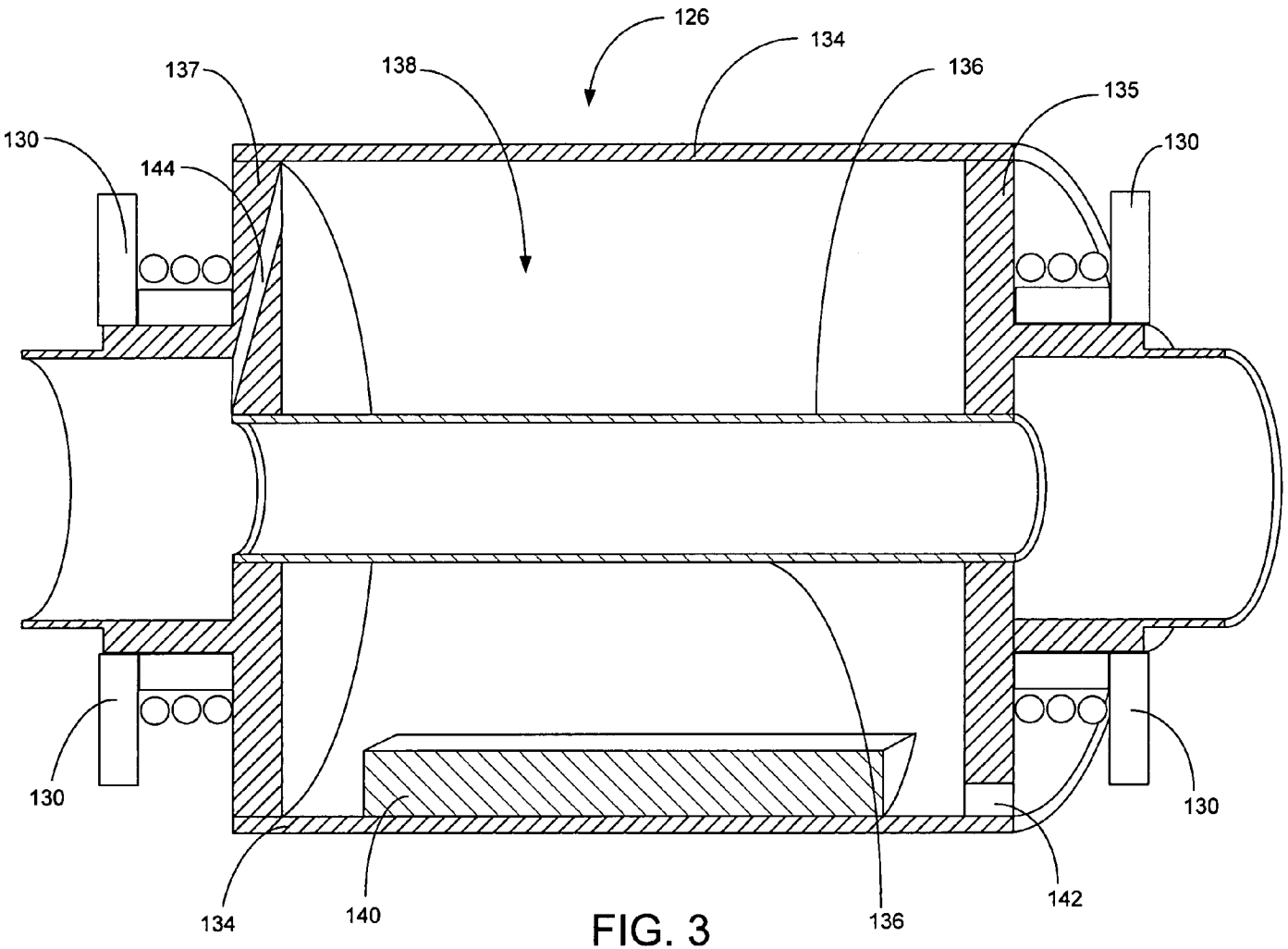
FIG. 3 is a side cross-sectional view of the rotatable gravity separator of the seal section of FIG. 2.

Referring now also to FIG. 3, shown therein is a close-up, cross-sectional view of one of the rotatable gravity separators 126. The rotatable gravity separator 126 is preferably configured as a closed-ended canister that includes an outer cylinder 134, an inner cylinder 136 and end walls 135, 137. A chamber 138 is defined by the annular space between the coaxial outer and inner cylinders 134, 136 and the end walls 135, 137. The outer cylinder 134 is preferably sized and configured to permit the movement of fluids between the outside wall of the rotatable gravity separator 126 and the inside wall of the housing 132 (shown in FIG. 2). The inner cylinder 136 is preferably sized and configured to permit the movement of fluids between the inner cylinder 136 and the shaft 122 (shown in FIG. 2).

The rotatable gravity separator 126 further includes a weight 140, a backwash inlet 142 and a backwash outlet 144. The weight 140 is preferably rigidly attached to the outer cylinder 134 inside the chamber 138. In a preferred embodiment, the weight 140 is configured as a rectangular member that is longitudinally aligned with the length of the rotatable gravity separator 126. In this position, the weight 140 acts as a counter-balance that causes the rotatable gravity separator 126 to rotate to decrease its potential energy. The weight 140 causes the rotatable gravity separator 126 to remain in a substantially constant orientation with respect to the force of gravity. In an alternate preferred embodiment, the weight 140 is attached inside the chamber 138 to the inner cylinder 136. In yet another alternate preferred embodiment, the weight 140 is secured to the outside of the rotatable gravity separator 126.

In the preferred embodiment, the backwash inlet 142 is positioned adjacent the weight 140 at the bottom of the chamber 138 and extends through the end wall 135. In this position, the backwash fluids are introduced through the backwash inlet 142 into the bottom of the chamber 138. The backwash outlet 144 is preferably located at the top of the chamber 138 on the opposite side of the chamber 138 and extends through the end wall 137. The backwash outlet 144 is preferably angled to direct fluid leaving the top of the chamber 138 to the space adjacent the shaft 122. The fluid leaving the backwash outlet 144 is partitioned from unfiltered fluid entering the chamber 138 by the mechanical seal 130.

As fluid passes through the chamber 138, solids and heavier fluids are pulled down by the force of gravity and separated from the lighter lubricants, which rise to the top of the chamber 138. Because the chamber 138 has a larger cross-section than the fluid exchange pathway 124, the velocity of the backwash fluid passing through the chamber 138 is reduced, thereby increasing residence time and separation efficiency. Because the rotatable gravity separator 126 remains in a position where the weight 140 and the backwash inlet 142 are below the backwash outlet 144, backwashed fluids will travel upward through the chamber 138 regardless of the rotational position of the seal section 112. Should the seal section 112 rotate during installation or use, the weighted rotatable gravity separator 126 will return to a position in which the rotatable gravity separator 126 is properly filtering backwashed fluid.

Thus, in a typical non-vertical well, fluid moving in the backwash direction into the labyrinth assembly 120 flows toward the motor assembly 110 along the outside of the rotatable gravity separator 126 and into the chamber 138 through the backwash inlet 142. In the chamber 138, gravity pulls the heavier, contaminated fluids and solids to the bottom of the chamber 138. At the same time, lighter, cleaner fluids travel in a generally upward direction, out of the top of the chamber 138 through the backwash outlet 144. Once outside the backwash outlet 144, the filtered fluid is directed along the shaft 122 toward downstream components, which may include additional rotatable gravity separators 126. It will be understood, however, that alternate flow-schemes around the labyrinth assemblies 120 could be employed with equal success and are contemplated as within the scope of the present invention.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A seal section for use in a pumping system, the seal section comprising:
a fluid exchange pathway; and
a rotatable gravity separator, wherein the gravity separator includes:
a chamber;
a backwash inlet connecting the chamber to the fluid exchange pathway;
a backwash outlet connecting the chamber to the fluid exchange pathway;
a weight positioned within the chamber, wherein the weight causes the rotatable gravity separator to remain in a substantially constant orientation with respect to the force of gravity; and
wherein the weight of the rotatable gravity separator is positioned within the chamber such that, in its position of lowest potential energy, the backwash inlet is below the backwash outlet.

2. The seal section of claim 1, wherein the seal section further comprises:
a housing; and
a bearing assembly captured within the housing, wherein the bearing assembly supports the rotatable gravity separator.

3. The seal section of claim 1, wherein the gravity separator further comprises:
an outer cylinder; and
an inner cylinder concentric with the outer cylinder, wherein the annular space between the outer cylinder and the inner cylinder defines the chamber.

4. The seal section of claim 3 further comprising a longitudinally oriented shaft, where,in the shaft passes within the inner cylinder of the gravity separator.

5. The seal section of claim 1, wherein the chamber of the rotatable gravity separator is sized and configured to reduce the velocity of fluids entering the chamber from the fluid exchange pathway.

6. A downhole pumping system comprising:
a pump assembly;
a motor assembly; and
a seal section connected between the pump assembly and the motor assembly, wherein the seal section comprises:
a fluid exchange pathway, wherein the fluid exchange pathway is configured to direct fluids moving between the pump assembly and the motor assembly; and
a rotatable gravity separator, wherein the gravity separator includes:
a chamber;
a backwash inlet connecting the chamber to the fluid exchange pathway;
a backwash outlet connecting the chamber to the fluid exchange pathway; and
a weight positioned within the chamber, wherein the weight causes the rotatable gravity separator to rotate to a position of lowest possible potential energy.

7. The downhole pumping system of claim 6, wherein the weight of the rotatable gravity separator is positioned within the chamber such that, in its position of lowest possible potential energy, the backwash inlet is below the backwash outlet.

8. The downhole pumping system of claim 6, wherein the seal section further comprises:
a housing;
a bearing assembly captured within the housing, wherein the bearing assembly supports the rotatable gravity separator; and
a mechanical seal that separates fluids entering and exiting the rotatable gravity separator.

9. The downhole pumping system of claim 8, wherein the bearing assembly includes ball bearings.

10. The downhole pumping system of claim 6, wherein the gravity separator further comprises:
an outer cylinder; and
an inner cylinder concentric with the outer cylinder, wherein the annular space between the outer cylinder and the inner cylinder defines the chamber.

11. The downhole pumping system of claim 10 further comprising a longitudinally oriented shaft that transmits mechanical energy from the motor assembly to the pump assembly, wherein the shaft passes within the inner cylinder of the gravity separator.

12. The downhole pumping system of claim 6, wherein the chamber of the rotatable gravity separator is sized and configured to reduce the velocity of fluids entering the chamber from the fluid exchange pathway.

13. The downhole pumping system of claim 6 further comprising a plurality of rotatable gravity separators.

14. A seal section for use in a downhole pumping system, the seal section comprising:
a fluid exchange pathway; and
a rotatable gravity separator, wherein the gravity separator includes:
a backwash inlet connecting the chamber to the fluid exchange pathway;
a backwash outlet connecting the chamber to the fluid exchange pathway; and
a weight, wherein the weight causes the gravity separator to rotate to a position of decreased potential energy in which the backwash inlet is lower than the backwash outlet.

15. The seal section of claim 14, wherein the rotatable gravity separator further comprises:
an outer cylinder having an outer wall and an inner wall;
an inner cylinder having an outer wall and an inner wall; and
a chamber defined by the annular space between the inner wall of the outer cylinder and the outer wall of the inner cylinder.

16. The seal section of claim 15, wherein the weight is positioned within the chamber proximate the backwash inlet.

17. The seal section of claim 15, wherein the weight is connected to the inner wall of the outer cylinder within the chamber.

18. The seal section of claim 15, wherein the weight is connected to the outer wall of the inner cylinder within the chamber.

19. The seal section of claim 15, wherein the weight is connected to the outer wall of the outer cylinder outside the chamber.

* * * * *